US006889608B2

(12) United States Patent
Pitz

(10) Patent No.: US 6,889,608 B2
(45) Date of Patent: May 10, 2005

(54) METHOD FOR DRYING A PRINTING INK ON A PRINTING SUBSTRATE, AND PRINT UNIT SUITED FOR IMPLEMENTING THE METHOD

(75) Inventor: Heiner Pitz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/815,002

(22) Filed: Mar. 31, 2004

(65) Prior Publication Data

US 2004/0200370 A1 Oct. 14, 2004

(30) Foreign Application Priority Data

Apr. 9, 2003 (DE) ..... 103 16 471

(51) Int. Cl.[7] ..... B41F 35/00; B41L 41/00

(52) U.S. Cl. ..... 101/424.1; 101/491; 106/31.28

(58) Field of Search ..... 101/424.1, 493; 106/31.27, 31.28; 430/302, 270.1, 17

(56) References Cited

U.S. PATENT DOCUMENTS

| | | | | | |
|---|---|---|---|---|---|
| 4,991,506 | A | | 2/1991 | Rodi | 101/416.1 |
| 5,832,333 | A | * | 11/1998 | Umeda et al. | 399/48 |
| 5,858,583 | A | * | 1/1999 | Dessauer et al. | 430/17 |
| 6,026,748 | A | | 2/2000 | Reed et al. | 101/424.1 |
| 6,231,652 | B1 | * | 5/2001 | Koyano et al. | 106/31.27 |
| 6,336,720 | B1 | * | 1/2002 | Suzuki et al. | 347/88 |
| 6,350,071 | B1 | * | 2/2002 | Conwell et al. | 400/118.2 |
| 6,482,571 | B1 | * | 11/2002 | Teng | 430/302 |
| 6,503,691 | B1 | * | 1/2003 | Goodin et al. | 430/278.1 |
| 6,605,407 | B2 | * | 8/2003 | Yu et al. | 430/270.1 |
| 6,675,494 | B1 | | 1/2004 | Oechsle et al. | 34/245 |
| 2003/0075063 | A1 | * | 4/2003 | Pitz | 101/424.1 |
| 2003/0235776 | A1 | * | 12/2003 | Goodin et al. | 430/270.1 |

FOREIGN PATENT DOCUMENTS

| | | |
|---|---|---|
| DE | 44 35 077 | 11/1995 |
| DE | 198 55 940 | 6/2000 |
| DE | 101 07 682 | 8/2002 |
| DE | 102 34 076 | 4/2003 |
| EP | 0355 473 | 2/1990 |

* cited by examiner

*Primary Examiner*—Eugene H. Eickholt
(74) *Attorney, Agent, or Firm*—Davidson, Davidson & Kappel, LLC

(57) ABSTRACT

A method for drying a printing ink (114) on a printing substrate (14) in a printing press (40), one printing ink (114) having one color pigment being used to print on the printing substrate (14) at one position (18) of a path (16) along which the printing substrate is conveyed through the printing press (40), and, at a chronologically later point in time, at one further position (116) of the path (16), the printing substrate (14) being illuminated with light (12) from a laser light source (10) having a wavelength of between 350 nm and 700 nm, the wavelength being resonant to an absorption wavelength of the color pigment of the printing ink (114). A print unit (30) for implementing the method is described which has a laser light source (10) which emits light (12) of a wavelength of between 350 nm and 700 nm.

15 Claims, 3 Drawing Sheets

METHOD FOR DRYING A PRINTING INK ON A PRINTING SUBSTRATE, AND PRINT UNIT SUITED FOR IMPLEMENTING THE METHOD

This claims the benefit of German Patent Application No. 103 16 471.5, filed Apr. 9, 2003 and hereby incorporated by reference herein.

The present invention is directed to a method for drying a printing ink on a printing substrate in a printing press, at least one printing ink having at least one color pigment being used to print on the printing substrate at one position of a path along which the printing substrate is conveyed through the printing press, and, at a chronologically later point in time, the printing substrate being illuminated with light from a laser light source at at least one further position of the path. The present invention is also directed to a print unit having a laser light source for implementing the method.

BACKGROUND

Depending on the type of printing ink and the underlying special drying process, different types of printing press installations are known, in particular planographic presses, such as lithographic presses, rotary presses, offset presses, flexographic presses, and the like, which process sheet- or web-shaped printing substrates, in particular paper, cardboard, carton, and the like, which initiate or promote an adhesion of the ink to the printing substrate, in that radiant energy, in particular in the form of light, is fed to the printing ink located on the printing substrate.

The so-called UV inks cure by polymerization, which is triggered by photoinitiation using ultraviolet light. On the other hand, solvent-containing printing inks, which are able to undergo both a physical as well as a chemical drying process, are very common. Physical drying encompasses the evaporation of solvents and the diffusion into the printing substrate (absorption), while chemical drying or oxidative drying is based on the polymerization of the oils, resins, binding agents, or the like, contained in the ink formulations, possibly with the co-action of atmospheric oxygen. The drying processes are generally dependent on one another, since the absorption of the solvents effects a separation between solvents and resins within the binding agent system, so that the resin molecules come closer together and possibly polymerize more easily.

The European Patent 0 355 473 A2, related to U.S. Pat. No. 4,991,506, both of which are incorporated by reference herein, for example, describes a device for drying printed products, which includes a radiant energy source in the form of a laser. The radiant energy is transmitted to the surface of the printing substrates, which are conveyed along a path through the printing press by a transport device, at a position between individual print units or following the last print unit, before or in the delivery unit. In this context, the radiation source can be a laser in the ultraviolet region for UV inks or a laser light source for heating solvent-containing printing inks. The radiant energy source is configured outside of the printing press to prevent parts of the press from being undesirably heated because of dissipation heat that cannot be avoided or that cannot be shielded. Here, the disadvantage is, however, that an additional system component must be separately provided for the printing press.

To remove solvents from a solvent-containing printing ink and/or water, it is also known from U.S. Pat. No. 6,026,748, for example, for a printing press to be provided with a drying device having infrared lamps, which emit short-wavelength infrared light (near infrared) or medium-wavelength infrared light. The emission spectrum of lamp light sources is broadband and, therefore, offers a multiplicity of wavelengths. The drawback of such drying devices in the infrared region is that a considerable proportion of the energy absorption takes place in the paper, the ink only being indirectly heated. A rapid drying is only possible by inputting enough energy. In the process, however, there is the danger, inter alia, of the printing substrate drying out unevenly and becoming warped.

In electrophotographic printing technology, it is known, for example, from the German Patent Application No. 44 35 077 A1, hereby incorporated by reference herein, to fix toner to a recording medium by using radiant energy in the near infrared region emitted by diode lasers. A narrow-band light source is used to heat the toner particles, in order to melt them, to form them into a colored coating, and to anchor them to the surface of the recording medium. Since in this spectral region, a considerable number of common paper grades have broad absorption minima, it is possible that a predominant share of the energy is directly absorbed into the toner particles.

Moreover, it is known from the German Patent Application No. DE 101 07 682 A1, hereby incorporated by reference herein, that an electrophotographic printing press or copy machine can have a plurality of fixing devices for toner, each of the fixing devices having a wavelength range of electromagnetic radiation which corresponds to a maximum absorption wavelength of the type of toner assigned to this fixing device, but exhibiting no or only little absorption at absorption wavelengths of other types of toner.

However, the simple knowledge of the window in the paper absorption spectrum cannot be directly exploited in printing technology that uses solvent-containing printing inks, since, as described above, there are other underlying chemical and/or physical drying processes. In the context of the present invention, the concept of solvent-containing printing ink connotes, in particular, inks whose solvent constituents may be of an aqueous or organic nature, which are derived from binding agent systems, which are able to be oxidatively, ionically or radically polymerized. An energy input for drying solvent-containing printing inks is intended to assist or promote the effect of evaporation of the solvent and/or the effect of absorption into the printing substrate and/or the effect of polymerization, unwanted secondary effects, such as a too intense heating of the solvent-containing printing ink, which can lead to a breakdown of components, or overheating of the solvent, being avoided at the same time. It is not intended for the energy input to be introduced just for melting particles, as in the case of fixing the toner.

German Patent Application No. DE 102 34 076 A1, hereby incorporated by reference herein, describes admixing an infrared absorber—a substance which absorbs in the near infrared spectral region—to a printing ink to be used for printing in a print unit. A narrow-band radiant energy source, preferably a laser light source, configured downstream from the printing nip, is used to illuminate the printing ink on the printing substrate. Supplying light of one wavelength that is essentially resonant to an absorption wavelength of the infrared absorber, effects, renders possible, or promotes an energy input into the printing ink in a way that dries the printing ink. At the same time, in order to minimize or avoid energy input into the printing substrate, the wavelength of the radiant energy source and the absorption wavelength of the infrared absorber are selected in such a way that the wavelength used is not resonant to water.

SUMMARY OF THE INVENTION

An object of the present invention is to devise a method for drying printing ink in a printing press using light from a narrow-band radiant energy source, the need being eliminated for admixing an infrared absorber substance to the printing inks to be used for printing. It is also intended to devise a print unit suited for implementing this method.

In the method according to the present invention for drying a printing ink on a printing substrate, the printing substrate is conveyed along a path through the printing press. At one position, one section or one coordinate value of the path, at least one printing ink, in particular one offset printing ink having at least one color pigment, is printed on the printing substrate. At a chronologically later point in time, i.e. subsequently thereto, at at least one further position of the path, the printing substrate is illuminated with light from a narrow-band radiant energy source, a laser light source, the light having a wavelength, in particular only one wavelength, of between 350 nm and 700 nm, which is resonant to an absorption wavelength of the at least one color pigment of the at least one printing ink. In this context, narrow-band means that the light source emits around a central wavelength, only wavelengths of ±20.0 nm, preferably ±10.0 nm, in particular ±2 nm, or even only one spectroscopically narrow line. In other words, in the method according to the present invention, a laser light source is used which emits light of one wavelength of between 350 nm and 700 nm, the light being resonant to an absorption wavelength of the at least one color pigment of the at least one printing ink. Resonant as defined herein means substantially resonant. This renders possible an efficient and rapid drying process. The need is eliminated for infrared absorber substances in the ink.

The method according to the present invention is based on the realization that the excellent absorbency of color pigments, in particular of standard pigments used in printing inks, especially offset printing inks, may be utilized to couple an energy input, in the form of light, into the ink film of a printing substrate freshly printed with a printing ink. In other words, the absorption of the radiant energy is assisted, rendered possible, effected, or at least accelerated by the at least one color pigment in the printing ink. The drying process is able to be influenced by the heat being generated. If necessary, chemical reactions are initiated by the generated heat. For an existing color pigment having an absorption of a specific wavelength, preferably an absorption maximum of a specific wavelength, special laser light sources may be used which emit light at this specific wavelength.

In a preferred embodiment of the method, the wavelength of the light used is between 450 nm and 750 nm. Color pigments of commonly used offset printing inks (standard: cyan C, magenta M, yellow Y and black K), absorb very well between 350 nm and 700 nm: at 400 nm to 500 nm, typically the printing inks C, M, Y, K, at 400 nm to 600 nm C, M, K, and at 400 nm to 750 nm C and K. The absorption maxima of typical color pigments are as follows: C (CLARIANT standard pigment blue 15:3) 650±100 nm, at low absorption, also below 550 nm to 400 nm, M (CLARIANT standard pigment red 57:1) 500±100 nm, and Y (CLARIANT standard pigment yellow 13) 400±100 nm. In this spectral region, the printing substrate of paper, and water ($H_2O$) have low absorbencies. The absorption by water is less than 10%, in a preferred embodiment less than 1%, preferably less than 0.1%. Above 400 nm, the absorption of the paper printing substrate drops off sharply, and in the region of between 450 nm and 750 nm, is not relevant (i.e., in any case less than 20%, in a preferred embodiment less than 10%, in particular less than 5%). The wavelength of the light is preferably resonant to an absorption maximum of the at least one color pigment of the at least one printing ink. In other words, the radiant energy source emits a wavelength corresponding to the absorption of the color pigment. The light emitted by the radiant energy source is thus preferably resonant or quasi-resonant to an absorption wavelength, in particular of the absorption maximum of the color pigment, so that a best possible correspondence is achieved between the absorption of the color pigment and the emission maximum of the laser light source. One color pigment may have one or more local absorption maxima. The wavelength of the emitted light is resonant to an absorption wavelength of the color pigment when the wavelength of the light resides at least in the flank of the (spectroscopic) absorption line of the color pigment. At the least, the absorption wavelength and the wavelength should differ by less than +/−50 nm.

Alternatively or in addition thereto, the wavelength of the light may not be resonant to the absorption wavelengths of water ($H_2O$). In the context of the present invention, "non-resonant" to the absorption wavelengths of water is understood to mean that the absorption of the radiant energy by water at 20° C. is not stronger than 10.0%, in a preferred variant, not stronger than 1.0%, in particular is less than 0.1%. In other words, the narrow-band radiant energy source, in particular laser light source, may emit only a very low intensity of light, preferably no light at all which is resonant to the absorption wavelengths of water.

The method according to the present invention may be applied quite advantageously to a number of printing inks to be used in printing. At a number of positions along the path through the printing press, a number of different printing inks are printed on the printing substrate, each of the printing inks having at least one different color pigment. At at least one further position of the path, the printing substrate is illuminated with light of a number of different wavelengths, in each instance, one of the different wavelengths being resonant to one of the absorption wavelengths of the different color pigments. In other words, the method according to the present invention may be used for a number of printing inks in multi-color printing, in each instance, one resonant wavelength being used for one color pigment for one of the printing inks used.

With respect to the topology in the printing press, the thus refined method of the present invention may be carried out in the following manner: The printing substrate may be illuminated at a number of further positions of the path, with light of a number of different wavelengths, the printing substrate being illuminated with one wavelength chronologically later than the printing using a number of printing inks to whose color pigment the wavelength is resonant, and chronologically before the printing using a different one of the number of printing inks not yet used in printing. In particular, the printing substrate may be illuminated with light of one wavelength which is resonant to an absorption wavelength of a color pigment at one position, which is configured downstream from the position where the printing ink having the color pigment is applied to the printing substrate, and upstream from another position where another printing ink having a different color pigment is printed on the printing substrate.

Alternatively thereto, the printing substrate may be illuminated at one position of the path with light of the number of different wavelengths chronologically after being printed on with the number of different printing inks. Expressed differently, on its path through the printing press, the printing substrate passes the number of positions where the number of printing inks is applied, before being irradiated with light from the number of wavelengths.

A relatively high energy input directly into the printing ink, assisted by the absorbency of the color pigment or pigments, is advantageously possible without energy being input in an unwanted manner into the printing substrate. The total required energy input is reduced. The radiant energy is absorbed in the printing ink at a rate of more than 30%, preferably 50%, in particular 75%, and even at a rate of more than 90%.

Also provided in the context of the inventive idea is a print unit having at least one laser light source, which is configured upstream from the print unit, in particular downstream from the printing nip along the path of the printing substrate through the print unit. The print unit according to the present invention is suited for implementing the method of the present invention in accordance with this description, the light from the laser light source having a wavelength of between 350 nm and 700 nm, in order to achieve a most narrow-band emission possible, at the same time maintaining a high spectral power density.

The laser light source is preferably a semiconductor laser (diode laser, quantum well laser, InGaAsP laser), a gas laser (HeNe, argon ions), a solid-state laser (titanium sapphire, erbium glass, Nd:YAG, (Nd glass, Nd:$YVO_4$, Pr:ZBLAN, Yb:ZBLAN (PR laser, Yb-doped fluoride glass laser) or the like, a diode-pumped, frequency-multiplied solid state laser (DPSS laser) or a frequency-multiplied semiconductor laser. A solid-state laser may preferably be optically pumped by one or more diode lasers. The wavelength of the laser light source is advantageously 450 nm+/−50 nm, 500+/−100 nm, 525 nm+/−75 nm, 550 nm+/−50 nm, 600 nm+/−150 nm, 600+/−100 nm or 600 nm+/−50 nm. In particular, the central wavelength of the laser emission, preferably having a spectroscopically narrow line width, is: 430 nm+/−50 nm, 442 nm+/−50 nm, 457 nm+/−50 nm, 473 nm+/−50 nm or 532 nm+/−50 nm. Lasers of this kind may also be advantageously tunable on a limited scale. In other words, the output wavelength of the lasers may be variable. As a result, it is possible to tune to a desired wavelength, for example resonantly or quasi-resonantly to an absorption wavelength of a color pigment in the printing ink. An imaging optics may be located on the optical path along which the light propagates from the laser light source, the imaging optics being used to generate a widened or focused light beam, in particular light cone at the surface of printing substrate.

In one advantageous embodiment, the print unit according to the present invention has a number of laser light sources which are arrayed in a one-dimensional or a two-dimensional field (locally curved, globally curved or flat), or in a three-dimensional field, and whose light strikes the printing substrate at a number of positions. Using a number of individual laser light sources for individual regions on the printing substrate lowers the maximally required output power of the laser light sources. Typically, laser light sources having a low output power are less expensive and have a longer service life. Moreover, unnecessarily high dissipation heat is prevented. The radiant energy per surface area introduced by the supplying of light is between 100 and 10,000 mJ per $cm^2$, preferably between 100 and 1,000 mJ per $cm^2$, in particular between 200 and 500 mJ per $cm^2$. The printing substrate is irradiated for a time duration of between 0.01 ms and 1 s, preferably between 0.1 ms and 100 ms, in particular between 1 ms and 10 ms.

It is especially beneficial when the light incident to the printing substrate at one position is controllable in its intensity and exposure duration for each laser light source independently of the other laser light sources. For this purpose, a control unit may be provided that is independent from or integrated in the machine control of the printing press. By controlling the laser light source parameters, it is possible to regulate the energy input at various positions of the printing substrate. An energy input may then be adapted to the coverage of the printing substrate at the positions in question on the printing substrate. Moreover, it is also beneficial to furnish the print unit according to the present invention with a number of laser light sources, so that light from at least two radiant energy sources is incident at one position on the printing substrate. On the one hand, this may be a question of partially overlapping light beams, and, on the other hand, of completely overlapping light beams. The maximum output power required of one individual laser light source is then less. Also, a redundancy is provided should one laser light source fail.

A printing press in accordance with the present invention is distinguished by at least one print unit having a laser light source in accordance with this description. Alternatively thereto, a printing press in accordance with the present invention having at least two print units may be distinguished in that the downstream print unit having a number of laser light sources for implementing the further refinement of the method according to the present invention, is used for a number of printing inks to be used for printing in accordance with this description, the light from the laser light sources having a number of wavelengths of between 350 nm and 700 nm. When the printing press is a sheet-processing press, the laser light source of the number of laser light sources of the downstream print unit may even be situated in the delivery unit. This geometry is also to be understood as "a downstream print unit having a number of laser light sources". In other words, the delivery unit of the printing press may have a number of laser light sources that are suited for implementing the method in accordance with this description, the laser light sources emitting a number of wavelengths of between 350 nm and 700 nm.

The printing press according to the present invention may be a direct or indirect planographic press, a lithographic press, offset press, flexographic press, or the like. On the one hand, the position where the light is incident to the printing substrate along its path through the printing press, may be downstream from the last printing nip of the last print unit of the number of print units, thus downstream from all printing nips. On the other hand, the position may also be downstream from a first printing nip and upstream from a second printing nip, thus at least between two print units. The printing press may be a sheet-processing or a web-processing press. A sheet-processing printing press may have a feeder, at least one print unit, optionally a surface-finishing unit (punching unit, varnishing system or the like) and a delivery unit. A web-processing printing press may include an automatic reelchange, a number of print units that print on both sides of the printing substrate web, a dryer, and a folder.

BRIEF DESCRIPTION OF THE DRAWINGS

Further advantages and advantageous refinements of the present invention are described on the basis of the following figures, as well as their descriptions, in which.

DETAILED DESCRIPTION

Figure 1:
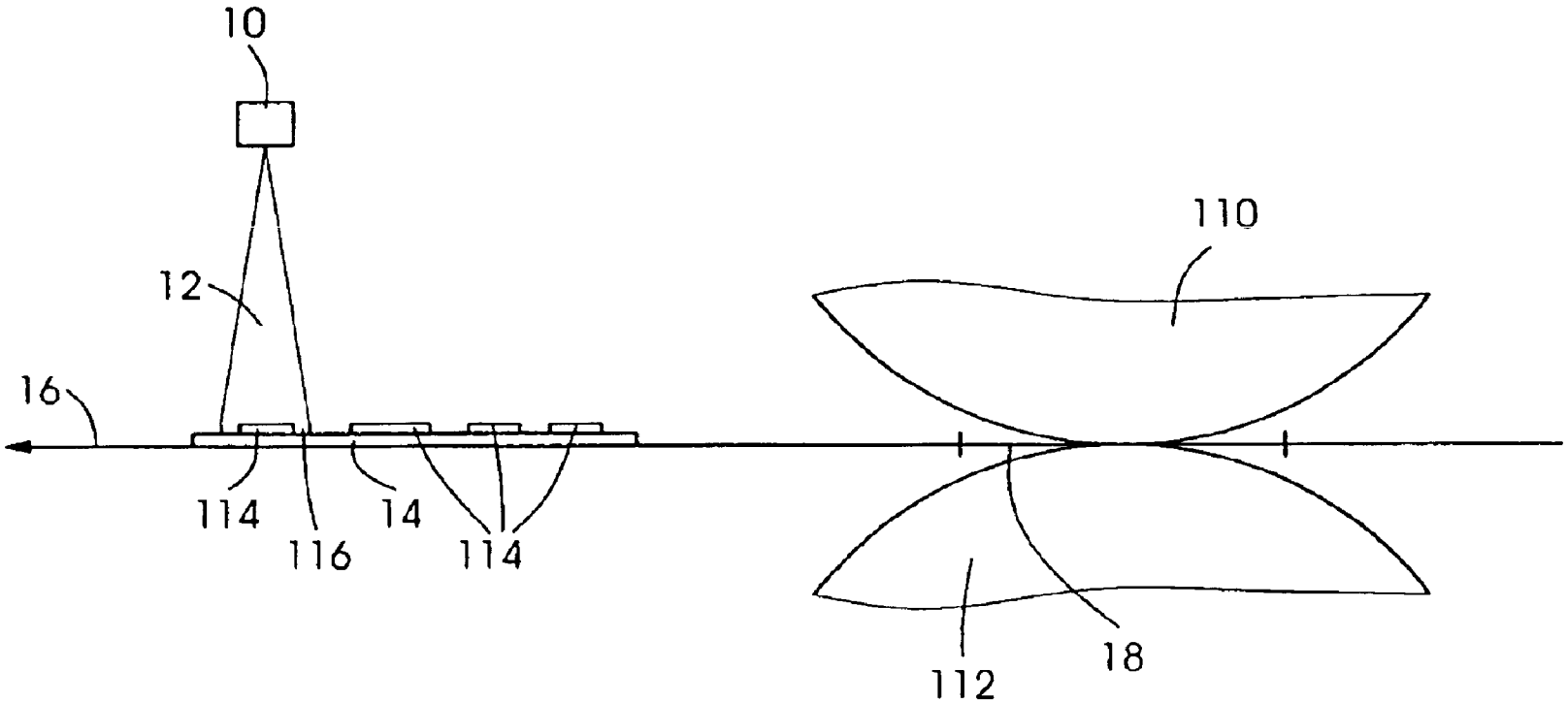
FIG. 1 shows a schematic representation for elucidating the method according to the present invention in a printing press.

FIG. 1 shows a schematic representation for explaining the method according to the present invention in a printing press. A laser light source 10, preferably a diode-pumped, frequency-multiplied solid state laser, emits light of a wavelength of between 350 nm and 700 nm and is situated within a printing press in such a way that light 12 emitted by it is incident to a printing substrate 14, which is conveyed on a path 16 through the printing press. The orientation of path 16 is characterized by an arrow. Path 16 passes a printing nip 18 between a printing cylinder 110 and an impression cylinder 112. Depending on the specific printing method employed in the printing press, printing cylinder 110 may be a printing-form cylinder or a blanket cylinder. At the position of printing nip 18 of path 16, at least one printing ink having at least one color pigment is printed on printing substrate 14. While in FIG. 1, printing substrate 14 is shown exemplarily in a sheet shape, in an alternative embodiment, the printing substrate may also be guided in a web shape through the printing press along path 16. Path 16 shown here is linear, but is not restricted thereto, and may likewise take a generally curve-shaped or non-linear course, in particular a circular arc.

Following passage through printing nip 18, printing ink 114 is shown on printing substrate 14. Chronologically after, i.e. subsequently to, the printing operation, at position 116 of path 16, printing substrate 14 is illuminated with light 12 from laser light source 10, light 12 having a wavelength of between 350 nm and 700 nm and being resonant to an absorption wavelength of the color pigment. Light 12 emitted by laser light source 10 is incident in a beam or cone, or carpet shape to printing substrate 14 at position 116. Printing ink 114 within position 116 is able to absorb energy from light 12. By selecting or tuning the wavelength of light 12, as advantageously provided by the present invention, energy is absorbed by the color pigment in printing ink 14, so that energy for drying printing ink 14 is introduced directly into printing ink 14.

Figure 2:
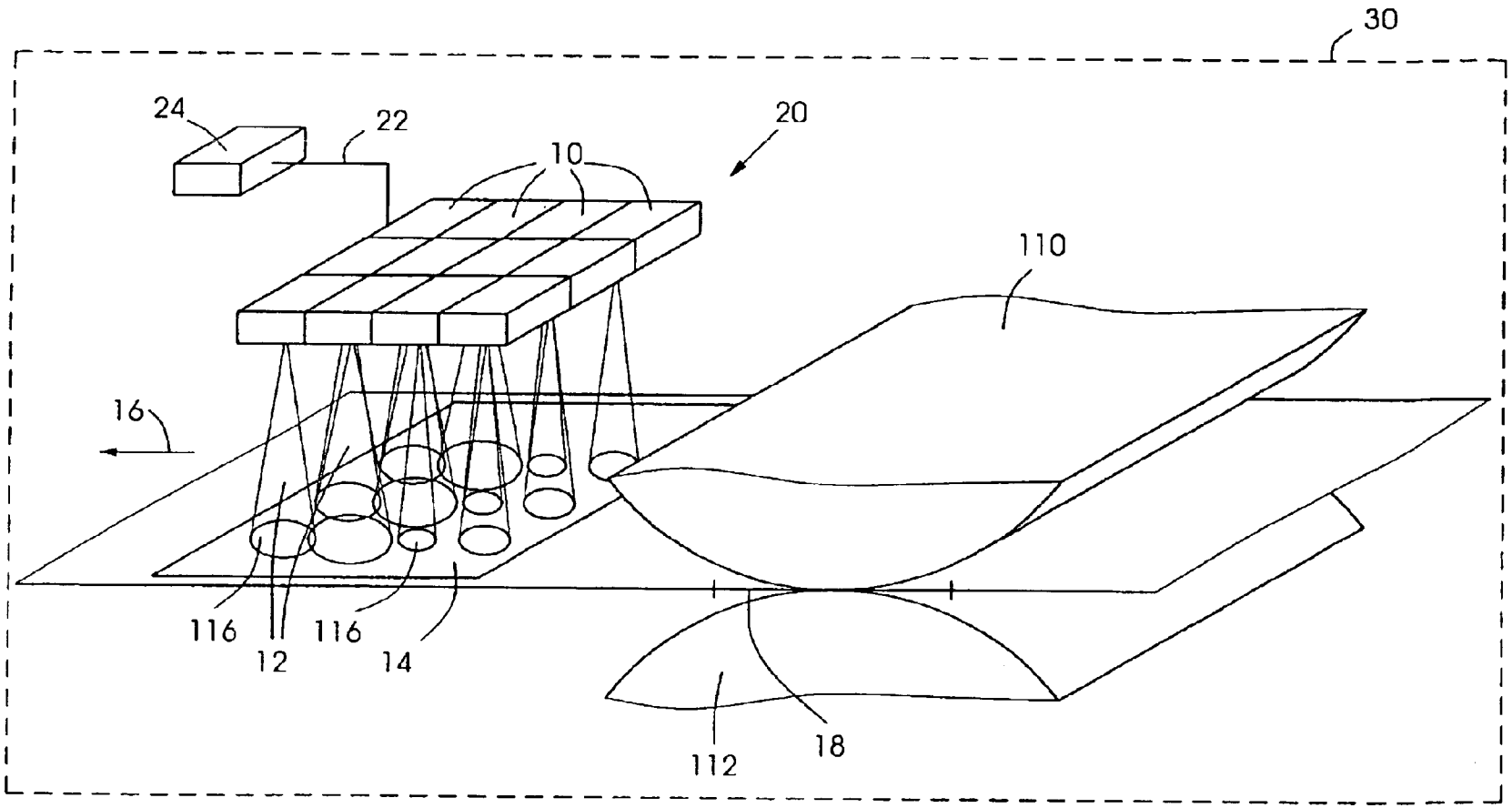
FIG. 2 shows a schematic representation of an advantageous embodiment of the print unit according to the present invention in a printing press.

FIG. 2 is a schematic representation of an advantageous specific embodiment of a further refinement of print unit 30 according to the present invention, having a number of laser light sources 10 in a printing press 40. A field 20 of laser light sources 10 is depicted, in this case, three times four, thus twelve laser light sources 10. Besides a two-dimensional field 20, a three-dimensional field or a one-dimensional row, oriented over the width of printing substrate 14, may also be provided. A two-dimensional field, as also a three-dimensional field, whose light is incident to printing substrate 14 in a two-dimensional distribution, has, inter alia, the advantage of achieving a rapid drying in that a group of positions in one column of field 20 is irradiated in parallel or simultaneously. Consequently, the velocity with which printing substrate 14 moves past laser light sources 10 may be higher than when working with an only one-dimensional field. Field 20 may also have a different number of radiant energy sources than that shown here in FIG. 2. Light 12 is supplied to printing substrate 14 from each of the number of laser light sources 10. Positions 116, where light 12 impinges on printing substrate 14, which follows a path 16 through the printing press, are disposed downstream from a printing nip 18, defined by a printing cylinder 110 and an impression cylinder 112. In this context, individual positions 116 may partially coincide, as shown in FIG. 2 for the front row of radiant energy sources 10, or, essentially, even completely overlap. Assigned to field 20 of radiant energy sources 10 is a control device 24, with which control signals may be exchanged via a connection 22. Field 20 may be driven by control device 24 in such a way that energy is input in accordance with the quantity of printing ink at position 116 on printing substrate 14. In this advantageous specific embodiment in particular, laser light sources 10 in field 20 are individually controllable in their duration and level of illumination.

Figure 3:
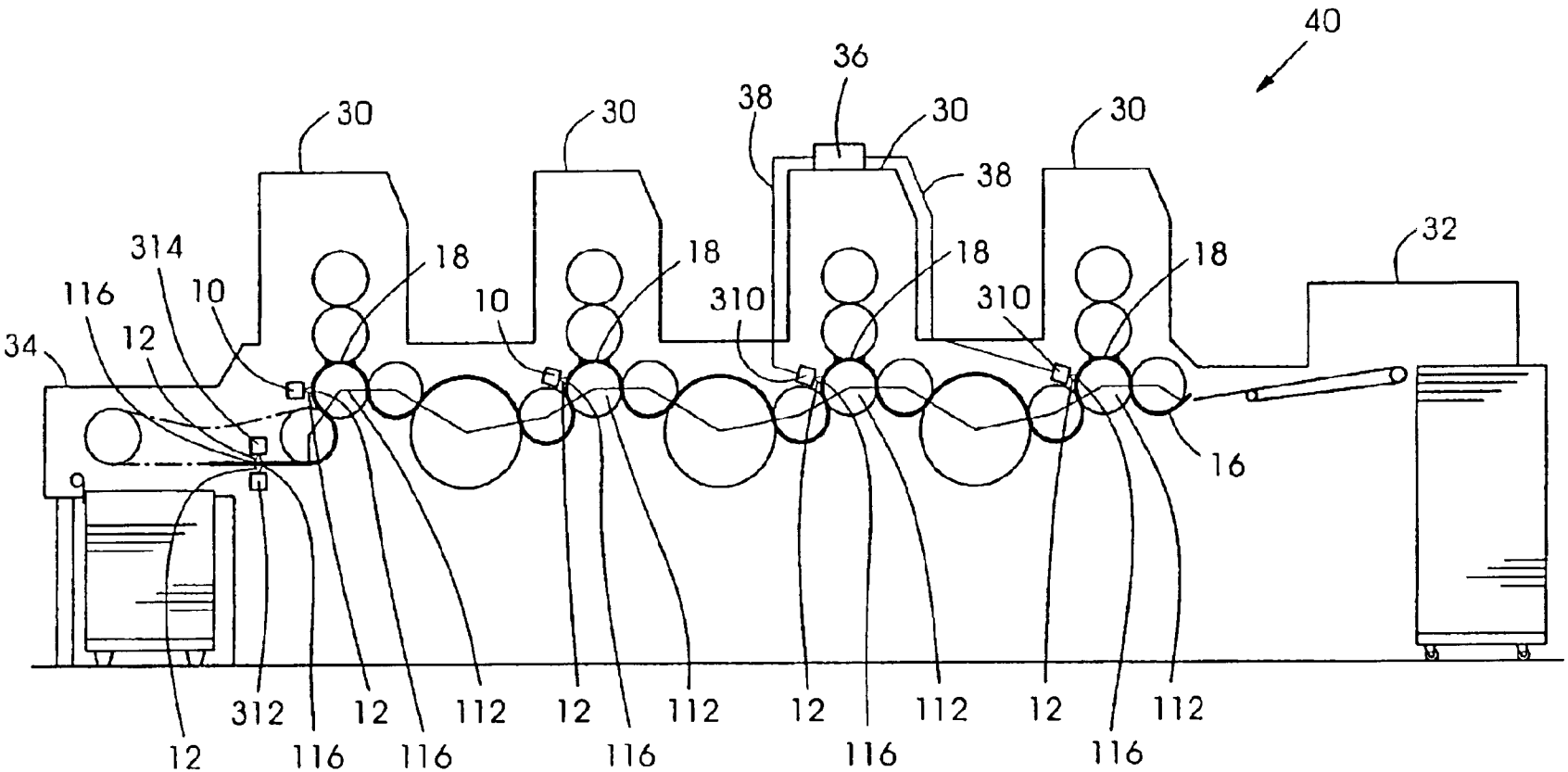
FIG. 3 shows a schematic representation of a printing press having various alternative configurations of laser light sources at the print units and after the last print unit, respectively.

FIG. 3 schematically illustrates a printing press, in this specific embodiment, a sheet-processing printing press, having various alternative configurations of laser light sources in print units according to the present invention. By way of example, printing press 4 has print units 30, a feeder 32, and a delivery unit 34. Within the printing press, various cylinders are shown, which, on the one hand, provide sheet guidance through the printing press and, on the other hand, provide a printing surface, whether it be directly as a printing-form cylinder or indirectly as a blanket cylinder. Typical print units 30 in printing press 40 also include an inking system and, optionally, a damping unit (not shown in greater detail). A printing substrate passes through printing press 40 along path 16.

Each print unit 30 includes a printing cylinder 110 and an impression cylinder 112, which define a printing nip 18, so that the printing substrate may be printed on at a number of positions (of the number of printing nips 18) with a number of different printing inks, each printing ink having at least one different color pigment. Within the printing press in accordance with FIG. 3, a plurality of possibilities are shown, how at at least one further position of path 16, printing substrate 14 is illuminated with light of a number of different wavelengths, in each instance, one of the different wavelengths being resonant to one of the absorption wavelengths of the different color pigments. In practical specific embodiments of a printing press, one of the illustrated possibilities may be used in each instance for all print units.

A first possible arrangement is shown on the basis of first and second print unit 30: The light emitted by a central laser light source 36 is conducted via light-conducting elements 38, for example, optical waveguides, mirrors, imaging optics and the like, to projection elements 310 assigned to print units 30. At position 116, projection elements 310 radiate light 12 onto path 16 of printing substrate 14 through the printing press, positions 116 being passed by the printing substrate chronologically after the printing is carried out using the printing ink having the color pigment, which is correlated with the wavelength of light 12. By using light-conducting elements 38, it is possible to position laser light source 36 at an appropriate location within or adjacently to printing press 40, in particular at print unit 30, where suitable space is available.

A second possible arrangement is illustrated on the basis of the third and fourth print unit 30 having laser light sources 10. Emanating from light sources 10, light 12 is directly supplied to path 16 of printing substrate 14. A possible arrangement of this kind has the topology already illustrated in FIGS. 1 and 2.

Finally, a third possibility for last print unit 30 is shown in FIG. 3: Last print unit 30, disposed downstream from further print units 30 of printing press 40, includes, in the direction of delivery unit 34, a laser light source 312 at an alternative position 116 and another laser light source 314 at a further alternative position 116. Alternative positions 116 may also already be in delivery unit 34. In the arrangement in accordance with the third possibility, at a position 116 of path 16, the printing substrate may be illuminated with light 12 of the number of different wavelengths chronologically after being printed on with all of the number of printing inks.

Analogously to the arrangements shown on the basis of a sheet-processing printing press in FIG. 3, print units in accordance with the present invention may also be advantageously used in a web-processing printing press, in particular in so-called rotary presses, whether it be for job printing or newspaper printing.

Reference Numeral List

10 light source
12 light
14 printing substrate
16 path of the printing substrate
18 printing nip
110 printing cylinder
112 impression cylinder
114 printing ink
116 position on the printing substrate
20 field of laser light sources
22 connection for transmitting control signals
24 control unit
30 print unit
32 feeder
34 delivery unit
36 central laser light source
38 light-conducting element
310 projection element
312 alternative radiant energy source
314 further alternative radiant energy source
40 printing press

What is claimed is:

1. A method for drying a printing ink on a printing substrate in a printing press comprising the steps of:

using at least one printing ink having at least one color pigment to print on the printing substrate at one position of a path, the printing substrate being conveyed through the printing press along the path; and subsequently to the using step, illuminating the printing substrate with light from a laser light source at at least one further position of the path, the light having a wavelength of between 350 nm and 700 nm and being resonant to an absorption wavelength of the at least one color pigment of the at least one printing ink.

2. The drying method as recited in claim 1 wherein the wavelength of light is between 450 nm and 750 nm.

3. The drying method as recited in claim 1 wherein the wavelength of light is resonant to an absorption maximum of the at least one color pigment of the at least one printing ink.

4. The drying method as recited in claim 1 wherein the wavelength of light is not resonant to absorption wavelengths of water.

5. The drying method as recited in claim 1 wherein the using step includes printing the printing substrate at a plurality of positions of the path with a plurality of different printing inks, each printing ink having at least one different color pigment, and the illuminating step includes, at at least one further position of the path, illuminating the printing substrate with light of a plurality of different wavelengths, in each instance, one of the different wavelengths being resonant to one of the absorption wavelengths of the different color pigments.

6. The drying method as recited in claim 5 wherein the at least one further position of the path includes a plurality of further positions, and the illuminating step includes, at the plurality of further positions of the path, illuminating the printing substrate with one wavelength chronologically later than the printing using one of the plurality of printing inks to whose color pigment the wavelength is resonant, and chronologically before the printing using a different one of the plurality of printing inks not yet used in printing.

7. The drying method as recited in claim 5 wherein the illuminating step includes, at the at least one further position of the path, illuminating the printing substrate with light of the plurality of different wavelengths chronologically after being printed on with the plurality of printing inks.

8. A print unit comprising:

at least one laser light source as recited in claim 1, wherein light from the at least one laser light source has a wavelength of between 350 nm and 700 nm.

9. The print unit as recited in claim 8 wherein the laser light source is a semiconductor laser, a gas laser, a solid-state laser, a diode-pumped, frequency-multiplied solid state laser, or a frequency-multiplied semiconductor laser.

10. The print unit as recited in claim 8 wherein the at least one laser light source includes a plurality of laser light sources being arrayed in a one-dimensional field, a two-dimensional field, or a three-dimensional field, and light from the plurality of laser light sources striking the printing substrate at a plurality of positions.

11. The print unit as recited in claim 8 wherein light incident to the printing substrate at a position is controllable in intensity and/or illumination duration for each laser light source.

12. The print unit as recited in claim 8 wherein the wavelength of laser light source is 430 nm+/−20 nm, 442 nm+/−20 nm, 457 nm+/−20 nm, 473 nm+/−20 nm or 532 nm+20 nm.

13. The print unit as recited in claim 8 wherein the at least one laser light source includes at least two laser light sources, light from the at least two laser light sources being incident to the printing substrate at one position.

14. A printing press comprising at least one print unit as recited in claim 8.

15. A printing press comprising:

at least two print units including a downstream print unit, the downstream print unit having the plurality of laser light sources suited for implementing the method as recited in claim 7, light from the laser light sources having a plurality of wavelengths of between 350 nm and 700 nm.

* * * * *